United States Patent [19]

Umezawa et al.

[11] Patent Number: 4,709,949

[45] Date of Patent: Dec. 1, 1987

[54] LATCH DEVICE

[75] Inventors: Takashi Umezawa, Sagamihara; Koji Watanabe, Fujisawa, both of Japan

[73] Assignee: Nifco, Inc., Yokohama, Japan

[21] Appl. No.: 877,710

[22] Filed: Jun. 23, 1986

Related U.S. Application Data

[63] Continuation of Ser. No. 626,984, Jul. 2, 1984, abandoned.

[30] Foreign Application Priority Data

Jul. 6, 1983 [JP] Japan ..... 58-103889[U]

[51] Int. Cl.[4] ..... E05C 19/02

[52] U.S. Cl. ..... 292/6; 24/645; 24/662; 292/45; 292/91; 292/198; 292/DIG. 4; 292/DIG. 38

[58] Field of Search ..... 292/49, DIG. 4, DIG. 38, 292/91, 45, 68, DIG. 72, 5, 6, 191, 229, 192, 198, 89; 24/645, 654, 656, 662

[56] References Cited

U.S. PATENT DOCUMENTS

| | | | |
|---|---|---|---|
| 3,015,869 | 1/1962 | Rapata | 292/DIG. 38 X |
| 3,120,971 | 2/1964 | Bengtsson | 292/91 |
| 3,164,406 | 1/1965 | Barry | 292/DIG. 4 |
| 3,479,075 | 11/1969 | Swanno | 292/DIG. 38 X |
| 3,669,481 | 6/1972 | Bergmann | 292/49 |
| 3,921,334 | 11/1975 | Black | 292/49 X |
| 4,322,914 | 4/1982 | McGaughey | 292/DIG. 38 X |
| 4,383,707 | 5/1983 | Nishimura | 292/DIG. 4 X |
| 4,482,175 | 11/1984 | Sugie | 292/DIG. 4 X |
| 4,616,861 | 10/1986 | Kurosaki | 292/45 X |
| 4,657,291 | 4/1987 | Kurosaki | 292/6 |

FOREIGN PATENT DOCUMENTS

| | | | |
|---|---|---|---|
| 967294 | 3/1950 | France | 292/49 |
| 181376 | 11/1962 | Sweden | 292/45 |
| 2060761 | 5/1981 | United Kingdom | 292/251.5 |

*Primary Examiner*—Lloyd A. Gall

*Attorney, Agent, or Firm*—Schwartz & Weinrieb

[57] ABSTRACT

A latch device is provided with a stationary cylinder to be fixed on a structure on which a door is hinged and a rod adapted to be driven into the cylinder against the resilience of a spring by a strike on the rear side of the door during the closing of the door, and the rod has the front half thereof formed in the shape of a pair of retention pieces connected separately through hinges of a small wall thickness into the rear half of the rod, so that while the rod is pushed into the stationary cylinder, the inner wall surface of the stationary cylinder will enable the retention pieces to grasp the strike and, while the door is opened, the rod will protrude from the stationary cylinder and slightly push the door open and, at the same time, the retention pieces will release the strike from retention therein.

16 Claims, 11 Drawing Figures

LATCH DEVICE

This application is a continuation of application Ser. No. 626,984, filed July 2, 1984, now abandoned.

BACKGROUND OF THE INVENTION

1. Field of the Invention

This invention relates to a lift type latch device which, when used on a handleless hinged door, for example, normally keeps the door locked in a closed state and, when the door is to be released from the closed state, allows the door to open slightly in its opening direction after a light momentary push is given to the door.

2. Description of Prior Art

Japanese Utility Model Application Public Disclosure SHO No. 58(1983)-148160 discloses a lift type latch notable for the very small number of its component parts. More specifically, it consists of a total of only four component parts: a stationary cylinder, a rod, a cam rotatably fixed on the rod, and a coil spring adapted to be simultaneously contracted between the stationary cylinder and the rod during the closing of the door and allowed to accumulate therein the resilient force for expelling the rod from the stationary cylinder during the opening of the door. In this conventional device, the rod is provided on the leading end thereof with a forked clip serving to retain resiliently a strike fastened on the rear side of the door. When the door is in its closed state, therefore, this clip keeps firm hold of the strike on the door and prevents the door from randomly opening.

When the door is slightly pushed in and readied for being fully opened, after the rod has protruded from the stationary cylinder and the door has been allowed to open slightly, the person wishing to open the door pulls the door slightly toward himself with his hand and makes the strike come off the clip. During this period, the rod is required to be retained within the stationary cylinder against the force exerted by the hand in the direction of opening the door toward the person. When the door in an open state is to be closed, the strike is required to be retained in the clip at the leading end of the rod. When the person opens the door or closes it, therefore, he is required to use not merely the force for opening and closing the door but also an extra force for releasing the strike from the rod and returning the strike into retention in the rod. Consequently, the strike is required to bear a force for retaining the rod and, therefore, tends to break.

OBJECT OF THE INVENTION

An object of this invention is to provide a latch device which normally keeps the door safely in a closed state and allows the door to be opened or closed smoothly by a mere light push of the door inwardly.

SUMMARY OF THE INVENTION

To accomplish the object described above, in the present invention the rod which is retracted into the stationary cylinder during the closing of the door and driven out of the stationary cylinder during the opening of the door has the front half thereof formed in the shape of a pair of retention pieces connected separately through hinges of a small wall thickness into the rear half of the rod, so that while the rod is pushed into the stationary cylinder, the inner wall surface of the stationary cylinder will enable the retention pieces to nip the strike into fast retention therein and, while the door is opened, the rod will protrude from the stationary cylinder and slightly push the door open and, at the same time, the retention pieces will release the strike from retention therein.

The latch device of this invention, therefore, does not impose any burden on the rod, particularly preparatory to the opening of the door, by compelling the door to be drawn forward to permit release of the strike from the clip as inevitably necessitated by the conventional device. Thus, there is no cause for trouble.

BRIEF DESCRIPTION OF THE DRAWINGS

The other objects and characteristics of this invention will become apparent to those skilled in the art from the further disclosure of this invention to be given in the following detailed description of a preferred embodiment, with reference to the accompaying drawings, wherein.

DESCRIPTION OF PREFERRED EMBODIMENT

Figure 3:
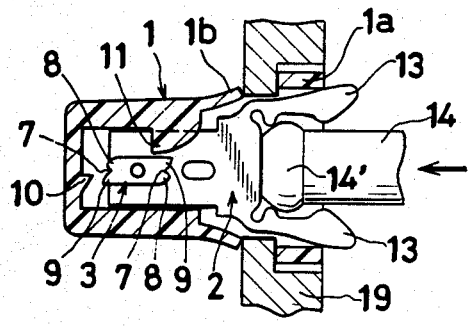
FIG. 3 is an explanatory view illustrating the state in which the rod of the lach device of this invention is pushed into the stationary cylinder.

First, a typical latch in which the present invention can be embodied will be described and the construction and operation of this latch will be explained. This latch comprises a stationary cylinder 1 closed at one end and open at the other end, a rod 2 the front half of which consists of a pair of retention pieces 13, a cam 3 rotatably fixed on the rod 2, and a coil spring 4 adapted to be compressed between the stationary cylinder and the rod. These components of the latch are molded pieces of plastics, except for the spring.

The rear half of the rod 2 has a cut-away portion 5 on the lower side thereof. The spring 4 is accommodated in this cut-away portion 5. When the rod 2 is driven into the stationary cylinder 1 by closing the door, the spring 4 is simultaneously compressed between the rear wall of the stationary cylinder 1 and the front wall 5' of the cut-away portion 5 and stores force which will be spent when the door is subsequently opened. The cam 3 is pivotably attached toward the back on the upper side of the rear half of the rod 2 and a stopper 6 is formed toward the front thereof.

The stopper 6 is held in engagement with an oblong hole 1' formed in the longitudinal direction in the upper wall of the stationary cylinder 1 to guide and regulate the sliding motion of the rod in the longitudinal direction.

As best seen in FIG. 3, the cam 3 has an overall length substantially equal to the width of the rear half of the rod 2 and is provided in the opposite end parts thereof with notches 7, smoothly rounded corners 8 each resembling a sloping human shoulder, and sharp corners 9 resulting from the intersection of the lateral sides of the cam and the sides of the notches, all symmetrically relative to the cam's center of rotation.

The stationary cylinder 1 is provided on the bottom of one inner wall thereof with a first projection 10 adapted to come into engagement with the notch 7 on one of the opposite end parts of the cam 3 and impart a slight rotation to the cam when the rod 2 is pushed in to the greatest extent and, at a small distance from the bottom on the other inner wall thereof, with a second projection 11.

Figure 4:
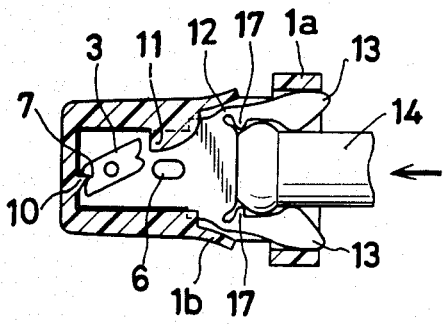
FIG. 4 is an exemplary view illustrating the state in which the rod is pushed into the stationary cylinder to the deepest recess thereof.

The operation of the cam 3 and the two projections 10, 11 will be described below. When the rod 2 is depressed against the spring 4 into the stationary cylinder 1 to the greatest depth by pushing the door (not shown) having a strike 14 slightly past the position at which it is normally kept closed, the cam is slightly rotated by the first projection (FIG. 4).

Figure 5:
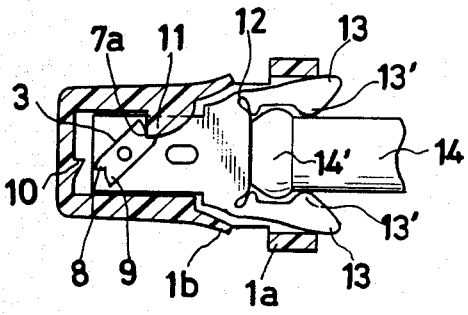
FIG. 5 is an explanatory view illustrating the state which the latch device assumes when the door is in a closed state.

When the push on the door is discontinued at this point, the rod 2 is forced slightly out by the resilient force of the coil spring 4 and the door is moved slightly in its opening direction. Then, one side **7*a* of the notch 7 of the slightly rotated cam 3 comes into engagement with the second projection 11, with the result that the cam is further rotated and one sharp corner 9 is caught on one inner wall of the stationary cylinder 1 and the cam 3 is brought to a frozen state after completing about 45° of rotation inside the stationary cylinder and consequently locked against the stationary cylinder. This is the point at which the door assumes its closed state (FIG. 5**).

Figure 6:
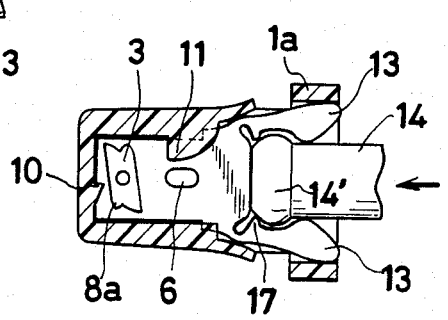
FIG. 6 is an explanatory view illustrating the state which the latch device assumes when the door in a closed state is further pushed inwardly.
Figure 7:
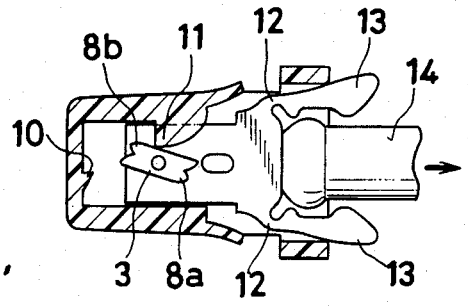
FIG. 7 is an explanatory view illustrating the state in which the rod is pushed out of the stationary cylinder.
Figure 8:
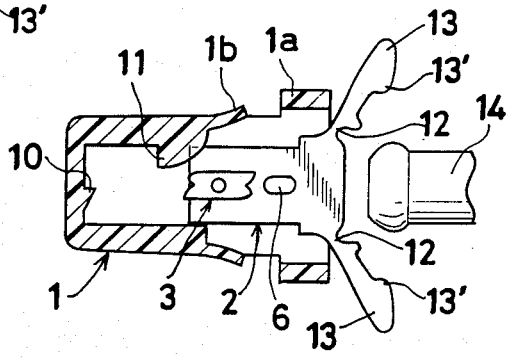
FIG. 8 is an explanatory view illustrating the state which the retention pieces forming the front half of the rod assume when they are driven out of the stationary cylinder.
Figure 1:
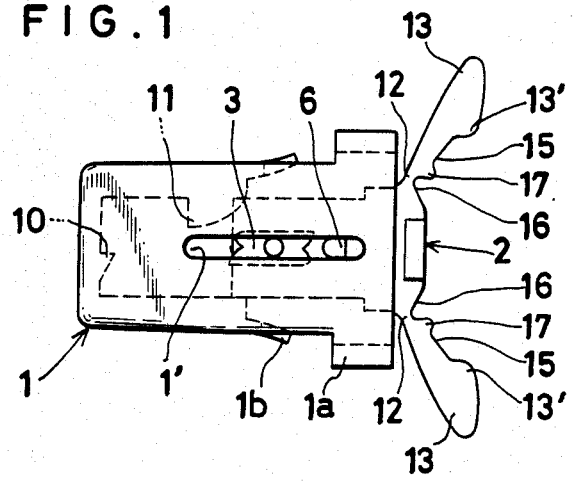
FIG. 1 is a plan view illustrating a typical latch device according to this invention.
Figure 2:
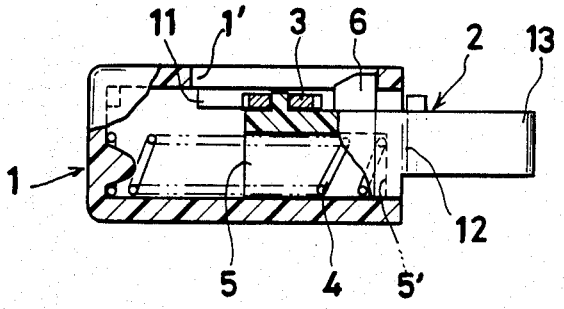
FIG. 2 is a longitudinally sectioned side view of the latch device of FIG. 1.

Another push is required to open the door. During this push, the rod 2 is again depressed to the greatest depth and the cam 3, with one rounded shoulder 8a thereof in contact with the first projection 10, is further rotated by about 45° and brought into a direction substantially perpendicular to the rod (FIG. 6). As the push is discontinued at this point, the rod 2 is pushed out by the resilient force of the spring 4 and the cam 3, with the rounded corner **8*b* brought into contact with the second projection 11, is further rotated by about 90° and brought into a direction substantially aligned with the rod 2 (FIG. 7). As a result, the rod is pushed out (FIG. 8) until the stopper 6 collides against the front end of the oblong hole 1'** and the door is opened to a slight extent.

In the present invention, the rod 2 which is pushed into stationary cylinder 1 during the closing of the door and pushed out of the stationary cylinder 1 during the opening of the door has the front half thereof formed of the pair of retention pieces 13 respectively connected through hinges 12 of a small wall thickness into the rear half adapted as described above to slide inside the stationary cylinder 1.

Figure 9:
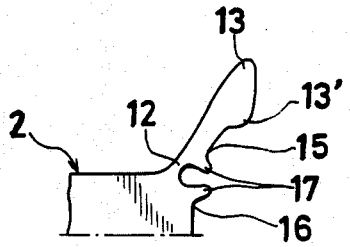
FIG. 9(A) is a plan view illustrating a part of other typical retention pieces of the rod.
FIG. 9(B) is an explanatory view illustrating the state which is assumed when the rod of FIG. 9(A) is pushed into the stationary cylinder.
Figure 9:
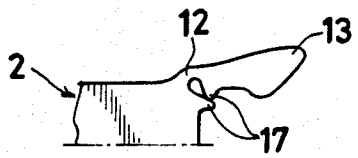
Figure 10:
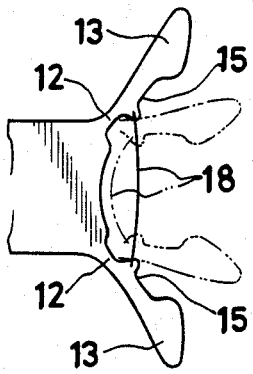
FIG. 10 is a plan view illustrating yet other typical retention pieces of the rod.

The retention pieces 13 are desired to be energized or actuated so as to be opened aslant outwardly and caused to assume a state not grasping the strike 14 on the rear side of the door. For this purpose, the retention pieces may be molded in a state opened aslant outwardly to impart the energizing force mentioned above to the hinges 12 thereof, the basal inner surfaces 15 on the hinge side of the retention pieces 13 and/or the laterally opposite end surfaces 16 of the rear half of the rod 2 opposed to the aforementioned basal inner surfaces 15 when the retention pieces 13 are moved in the direction of grasping the strike 14 may be provided thereon with protuberances 17 so that the protuberances 17 will be deformed when the retention pieces nip the strike (FIG. 9(A), (B)), or a leaf spring 18 may be bridged between the basal inner surfaces 15 of the two retention pieces 13 (FIG. 10).

In accordance with this invention, therefore, when the door is pushed so as to be closed, the strike 14 collides against the leading end of the rear half of the rod 2 and causes the rod 2 to be driven into the stationary cylinder 1 and the retention pieces 13 which constitute the front half of the rod, while verging on entering the stationary cylinder, are caused by the edge of the mouth of the stationary cylinder to move inwardly toward each other and consequently grasp the leading end of the strike (FIG. 3).

In this case, it is desirable to prevent the strike from coming free from the retention pieces as by providing the retention pieces 13 with swelled portions 13' adapted to grasp the strike at the portion slightly behind the leading end thereof and providing the strike with recesses slightly behind the leading end thereof thereby enabling the swelled portions 13' to grasp the strike by entering the recesses or by providing the strike at the leading end thereof with a radially expanded portion 14' and enabling the swelled portions 13' of the retention pieces 13 to grasp the strike behind the radially expanded portion 14'.

When the door is opened, the retention pieces 13 move outwardly from the leading end of the stationary cylinder 1 (FIG. 8) and cease to grasp the strike or, when the retention pieces are energized to be opened aslant outwardly, open positively and release the strike from its retention. The door, therefore, can be easily opened without requiring a strong forward pull to permit escape of the strike from the clip as has been inevitable with the conventional latch. The possibility of the latch device developing mechanical trouble such as in the stopper 6 is eliminated.

When the door in which this invention is embodied is used for the cabinet or the tuner section of a television set, for example, the stationary cylinder of the latch device can be readily fixed on the television set. To be specific, the front end parts **1*a* of the stationary cylinder are outwardly extending laterally and the opposite lateral walls of the stationary cylinder are provided one each with grooves of a cross section of the shape of three sides of rectangle to accommodate therein tongue pieces 1*b* having free ends thereof thrust out of the lateral walls, with the free ends of the tongue pieces 1*b* and the rear sides of the front end parts 1*a* separated by a distance substantially equal to the wall thickness of the television set 19 (FIG. 3). To admit the stationary cylinder, the television set has bored therein a hole of the shape conforming to the profile of the rear part of the stationary cylinder. As the stationary cylinder is inserted, with the rear part thereof in the lead, through this hole, the wall of the television set 19 is finally caught between the free ends of the tongue pieces 1*b*** and the rear sides of the front end portions 1*a*, completing the attachment with ease.

As is plain from the foregoing description, this invention has its characteristic feature in the construction of the retention pieces constituting the leading end of the rod for firmly retaining the strike. Thus, the operating mechanism of the latch device is not limited to that of the illustrated embodiment.

Obviously, many modifications and variations of the present invention are possible in light of the above teachings. It is therefore to be understood that within the scope of the appended claims, the present invention may be practiced otherwise than as specifically described herein.

What is claimed is:

1. A latch system defined between a stationary support structure and a closure movably mounted upon said support structure between an open, unlatched position, and a closed, latched position, comprising:

a cylinder fixedly mounted upon said stationary support structure;

a strike fixedly mounted upon said closure;

a rod, having strike-engaging means disposed thereon, and movably mounted within said cylinder between a first, strike-released outer position, and a second, strike-clamped inner position;

first means disposed within said cylinder for biasing said rod toward said first, strike-released outer position;

means disposed within said cylinder for releasably retaining said rod, and therefore said strike and said closure, in said second, strike-clamped inner position, and said closed, latched position, respectively;

said strike being provided upon the leading end thereof with a radially expanded portion;

said strike-engaging means of said rod comprising a central, strike-engaging portion for contact engagement with said leading end of said strike when said closure, and said strike and rod, are moved from said open, unlatched, and first strike-released outer, positions, respectively, toward said closed, latched, and second strike-clamped inner, positions, respectively, against the biasing force of said first biasing means; and a pair of strike-engaging arms projecting outwardly from opposite sides of said said central, strike-engaging portion for envelopingly engaging said radially expanded portion of said strike therebetween, said arms being mounted upon said central, strike-engaging portion of said rod for accommodation within said cylinder when said closure, and said strike and said rod, are moved from said open, unlatched, and first, strike-released outer, positions, respectively, toward said closed, latched, and second strike-clamped inner, positions, respectively; and rotary cam means mounted upon said rod for cooperation with said retaining means of said cylinder when said rod is moved from said first outer position to said second inner position so as to retain said rod at said second inner position such that said strike-engaging means are engaged with said closure strike whereby said closure is disposed in said closed state, and for disengaging said retaining means of said cylinder when an inwardly directed force is applied to said closed closure whereby said rod is able to move from said second inner position to said first outer position under the influence of said first biasing means so as to permit said strike-engaging means to disengage said closure strike such that said closure can assume said open state.

2. A latch system as set forth in claim 1, wherein:

said pair of arms includes recessed portions for housing said radially expanded portion of said strike.

3. A latch system as set forth in claim 1, wherein:

said central portion of said rod and said pair of arms are integrally formed together as a single piece structure.

4. A latch system as set forth in claim 3, wherein:

said rod is molded from a plastic material; and said arms are connected to said central portion of said rod by means of molded hinge mechanisms.

5. A latch system as set forth in claim 3, wherein:

said arms are normally divergently disposed upon said opposite sides of said central portion of said rod.

6. A latch system as set forth in claim 5, further comprising:

second means biasing said strike-engaging arms to said normally divergent position.

7. A latch system as set forth in claim 6, wherein:

said second biasing means comprises spring means interposed between said strike-engaging arms.

8. A latch system as set forth in claim 6, wherein:

said rod is molded from a plastic material; and said second biasing means are defined by molded hinge mechanisms interconnecting said strike-engaging arms to said rod sides.

9. A latch system as set forth in claim 1, wherein:

said rotary cam means is substantially rectangular in configuration.

10. A latch system as set forth in claim 9, wherein:

said rotary cam means is mounted upon the inner end of said rod.

11. A latch system as set forth in claim 10, wherein:

the length of said rotary cam means is substantially equal to the width of an inner end portion of said rod upon which said rotary cam means is mounted.

12. A latch system as set forth in Claim 9, wherein:

said rotary cam means includes notch means defined within opposite ends of said rotary cam means for engaging said retaining means of said cylinder.

13. A latch system as set forth in claim 12, wherein said retaining means of said cylinder comprises:

a first projection defined upon an end portion of said cylinder for engaging a first one of said notch means of said rotary cam means when said rod is moved from said first outer position to said second inner position so as to rotate said rotary cam means; and a second projection defined upon a side portion of said cylinder for engaging a second one of said notch means of said rotary cam means when said rotary cam means has been rotated by said engagement with said first projection of said cylinder so as to rotate said rotary cam means still further and thereby prevent movement of said rod from said second inner position back to said first outer position.

14. A latch system as set forth in claim 12, wherein said retaining means of said cylinder comprises:

a first projection defined upon an end portion said cylinder for engaging a first end of said rotary cam means when said rod is moved inwardly under the influence of said inwardly directed force applied to said rod disposed at said second inner position so as to rotate said rotary cam means to a first, partial-release position; and a second projection defined upon a side portion of said cylinder for engaging a second end of said rotary cam means as said rod is moved under the influence of said first biasing means from said second inner position to said first outer position so as to rotate said rotary cam means from said first, partial-release position to a second, full-release position.

15. A latch system as set forth in claim 12, wherein: said notch means are substantially V-shaped in configuration.

16. A latch system as set forth in claim 15, wherein: said V-shaped notch means define diagonally opposed sharp and rounded corners with the longitudinal sides of said substantially rectangularly configured rotary cam means.

* * * * *